United States Patent [19]

Forsyth et al.

[11] Patent Number: 4,487,991

[45] Date of Patent: Dec. 11, 1984

[54] FULLY SYNTHETIC TAPED INSULATION CABLES

[75] Inventors: Eric B. Forsyth, Brookhaven; Albert C. Muller, Center Moriches, both of N.Y.

[73] Assignee: The United States of America as represented by the United States Department of Energy, Washington, D.C.

[21] Appl. No.: 514,127

[22] Filed: Jul. 15, 1983

[51] Int. Cl.[3] ..... H01B 3/18; H01B 7/02

[52] U.S. Cl. ..... 174/25 R; 174/26 R; 174/110 PM

[58] Field of Search ..... 174/25 R, 25 G, 26 R, 174/26 G, 110 PM, 120 FP

[56] References Cited

U.S. PATENT DOCUMENTS

| | | | |
|---|---|---|---|
| 2,112,322 | 3/1938 | Wyatt | 174/25 R |
| 2,512,459 | 6/1950 | Hamilton | 174/110 PM |
| 3,077,510 | 2/1963 | Olds | 174/25 R |
| 3,077,514 | 2/1963 | Kang | 174/25 R |
| 3,078,333 | 2/1963 | Kang | 174/25 R |
| 3,094,583 | 6/1963 | Eich et al. | 174/25 R |
| 3,105,872 | 10/1963 | Thompson et al. | 174/25 R |
| 3,194,872 | 6/1965 | Garner | 174/25 R |
| 3,217,084 | 11/1965 | Feick | 174/25 R |
| 3,229,024 | 1/1966 | Kang | 174/25 R |
| 3,269,862 | 8/1966 | Lanza et al. . | |
| 3,358,071 | 12/1967 | Eich et al. | 174/25 R |
| 3,378,419 | 4/1968 | Eich et al. | 174/25 R |
| 3,429,983 | 2/1969 | Hofmeier | 174/25 R |
| 3,430,116 | 2/1969 | Johnstone | 174/25 R |
| 3,459,871 | 8/1969 | Eager, Jr. et al. | 174/25 R |
| 3,594,489 | 7/1971 | Katz et al. | 174/25 R |
| 3,621,110 | 11/1971 | McGrath | 174/25 R |
| 3,748,372 | 7/1973 | McMahon et al. | 174/25 R |
| 3,749,812 | 7/1973 | Reynolds et al. | 174/25 R |
| 3,775,549 | 11/1973 | Matsuda et al. | 174/25 R |
| 4,237,334 | 12/1980 | Kojima et al. | 174/25 R |
| 4,276,251 | 6/1981 | Bopp | 174/120 AR X |
| 4,330,439 | 5/1982 | Nishimatsu et al. | 174/25 C X |
| 4,361,723 | 11/1982 | Hvizd, Jr. et al. | 174/120 SC X |

FOREIGN PATENT DOCUMENTS

| | | | |
|---|---|---|---|
| 32454 | 8/1968 | Japan | 174/25 R |
| 25951 | 7/1972 | Japan | 174/25 R |
| 116600 | 11/1974 | Japan | 174/25 R |
| 896066 | 5/1962 | United Kingdom | 174/25 R |
| 1045527 | 10/1966 | United Kingdom | 174/25 R |

OTHER PUBLICATIONS

Sykes, J. H. M., Discuss EHV Underground Cable System; Electrical World; vol. 163, No. 20; May 17, 1965.

*Primary Examiner*—John Gonzales
*Assistant Examiner*—Morris H. Nimmo
*Attorney, Agent, or Firm*—Vale P. Myles; Paul A. Gottlieb; Michael F. Esposito

[57] ABSTRACT

A high voltage oil-impregnated electrical cable with fully polymer taped insulation operable to 765 kV. Biaxially oriented, specially processed, polyethylene, polybutene or polypropylene tape with an embossed pattern is wound in multiple layers over a conductive core with a permeable screen around the insulation. Conventional oil which closely matches the dielectric constant of the tape is used, and the cable can be impregnated after field installation because of its excellent impregnation characteristics.

18 Claims, 4 Drawing Figures

FULLY SYNTHETIC TAPED INSULATION CABLES

BACKGROUND OF THE INVENTION

The United States Government has rights to this invention pursuant to Contract Number DE-AC02-76CH00016 between the United States Department of Energy and Associated Universities, Inc.

This invention deals generally with electrical cables and more specifically with cables with multiple layers of insulation impregnated with insulating fluid.

The traditional methods of construction for high voltage cables, those using kraft paper insulation and oil impregnation, appear to have reached their practical limit in respect to voltage and, therefore, for power. At voltages above 345 kV the increased dielectric loss, along with the relatively poor heat transfer of cables using kraft paper, lowers the current capabilities of those cables, thus canceling many advantages of such increased voltage.

These problems have led to the development of paper and plastic laminated insulation which, while gaining some advantages, frequently introduces other limitations due to certain individual characteristics of each material. Thus, the impermeable plastic slows impregnation by the oil while the kraft paper still has relatively high dielectric loss.

The logical progression of cable technology has been toward all plastic insulation for high voltage cable, and several versions have been patented and constructed in limited quantity. U.S. Pat. No. 3,358,071 by E. D. Eich, et al, describes a cable using multiple layers of polysulfone tape, and U.S. Pat. No. 3,105,872 by H. E. Thompson, et al, describes a polycarbonate taped cable. Various other U.S. Patents, for instance U.S. Pat. Nos. 3,077,514 by B. P. Kang and 3,077,510 by W. F. Olds, have suggested other polymer tapes such as polyethylene and polypropylene with special configurations such as grooves (Kang) and channels (Olds).

Practical, industrially usable, cable designs using polymers such as polyethylene, polybutene, and polypropylene have, however, been elusive because of the inherent problems associated with these materials. They are, in standard commercial varieties, susceptible to dissolution, thickness swelling and shrinkage in typical impregnating fluids to an extent which prevents reliable long life. The Olds patent noted above, for instance, suggests the use of organosilicon polymer fluids to overcome this limitation and U.S. Pat. No. 3,229,024 by B. P. Kang suggests the use of highly crystalline polypropylene tape with polypropylene oil. U.S. Pat. No. 4,330,439 by Nishimatsu, et al, uses exotic diaryalkane compounds as insulating oil to assure compatibility with polyolefins.

Prior to the present invention no cable has been constructed by conventional cable building techniques which provides the superior electrical properties of polyethylene, polybutene or polypropylene along with the use of conventional impregnating fluids which could assure long life, reliability, higher voltage and higher current capabilities than paper insulated cables.

SUMMARY OF THE INVENTION

The present invention is a cable which, although constructed from inexpensive polyolefin tapes and using typical impregnating oils, furnishes high voltage capability up to 765 kV, and has such excellent dielectric characteristics and heat transfer properties that it is capable of operation at capacities equal to or higher than presently available cables at a given voltage.

This is accomplished by using polyethylene, polybutene or polypropylene insulating tape which has been specially processed to attain properties which are not generally found in these materials, but are required for their use in impregnated electrical cables. Chief among these properties is compatibility with impregnating oil. Polyethylene, polybutene and polypropylene in their commonly available forms, when immersed in hot conventional electrical insulating oil, are highly susceptible to thickness swelling, dissolution, stress cracking and length shrinkage.

To minimize these destructive phenomena, the polyolefin feed stock is biaxially oriented before use in the cable of the present invention. This involves stretching the tapes by rolling to a draw ratio of between 5 to 1 and 10 to 1 in the length direction and also orienting the tapes across their width.

The tape which results from rolling polyolefin stock to appropriate draw ratios has numerous qualities which make it superior for cable manufacture. To reduce the tape's tendency to fibrillate, to split over its entire length along a single tear, further processing is desirable. This processing involves a second linear orientation step in the direction across the tape. This orients the tape to a ratio of up to 50% in the cross-tape direction, and produces tape which is sufficiently biaxially oriented to satisfactorily limit the tendency to fibrillate.

The polyethylene and polypropylene tapes produced from the processing noted above are embossed with a particular pattern under specific conditions to assure proper cable impregnation and heat transfer. The embossing pattern consists of irregular channels primarily directed in the cross machine direction.

At the same time the pattern, while it may permit some oil flow in both the machine and cross-tape direction, must favor cross-tape flow because such flow enhances impregnation from layer to layer and encourages heat transfer by oil convection. The cable itself is constructed of multiple layers of polyolefin tape, either polyethylene, polybutene or polypropylene, using conventional cable winding machinery. To facilitate cable bending, several different widths of polyolefin tape are used in the layers. These sizes progress to larger widths with increased distance from the conductor of the cable.

It is also vital to the ultimate electrical characteristics of the insulating tape that antioxidants and other additives be properly selected and concentrations controlled in the original feedstock used for the rolling operation. When such materials as antioxidants, which are generally added to all polymer materials, are properly selected, dielectric loss tangent of the insulation can be kept below $2\times10^{-4}$.

To aid in the construction of the cable the otherwise highly transparent polyolefin insulating tape is produced with coloring added. This technique adds significantly to the ability to make a usable cable with conventional cable taping machines, because the operator must properly index each subsequent spiral layer of insulating tape with the immediate previous layer. When taping with the typical extremely clear and transparent polyethylene, polybutene or polypropylene tape, the operator is unable to distinguish the edges of the immediate previous layer from other edges as far as eight or ten tape layers beneath. The addition to the original feedstock of selected color dyes in specific quantities adds enough color to the tape to permit the cable machine operator to easily distinguish the edges, the butt gaps, of the immediate previous layer of tape from those of the earlier layers because the darkness of the color increases significantly with each layer. This coloring agent is selected so as to minimize any increase in dissipation factor of the original material.

The cable of the present invention is constructed with a screen layer over the final layer of insulating tape and a flat metal conductor tape over the screen. Both these layers are constructed to be permeable to the impregnating fluid. This is accomplished by perforating the layers with small holes.

The final layers of the cable of the present invention are conventional coverings and dependent upon the cable use. Self contained cables are enclosed with an oil tight jacket following impregnation, and pipe-type cables, if impregnated before installation, are covered with a low permeability oil retaining cover such as paper. Pipe type cables of the present invention may, however, be impregnated after installation, because the impregnating oil travels so easily within cables that field impregnation is now much more practical than before.

The cable of the present invention thus not only yields a significant increase in voltage and power handling capability over kraft paper cables, but furnishes distinct advantages in shipping, storage and installation, because of the reduced complexity of handling cables which do not yet contain oil. One such advantage is that kraft paper cables not only must be shipped with oil, but that they have a limited shelf life due to the danger of drying out. Clearly, polyolefin taped cables with no oil yet impregnated into them have no danger of losing their oil.

DETAILED DESCRIPTION OF THE INVENTION

Figure 1:
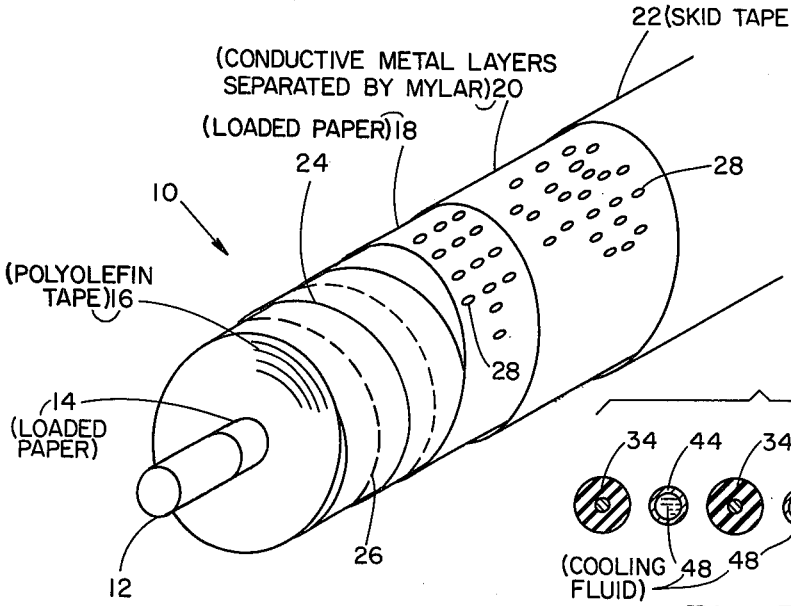
FIG. 1 is a perspective view of the preferred embodiment of the cable of the invention with various layers shown stripped away for better clarity.

The preferred embodiment of the invention is shown in FIG. 1 in which cable 10 is constructed with a central conductor 12, covered by screening or bedding layer 14 and insulated by multiple layers of polyolefin tape 16 wound in a spiral configuration, one on top of another. Insulating tapes 16 are covered by semiconductor screen 18, which is itself covered by conducting layer 20 and, finally, cable jacket 22. Skid wires (not shown) may also be added.

The construction shown is intended to be familiar to anyone skilled in the art of taping kraft paper insulation and using the same techniques. The width of the tapes may vary; narrow near the conductor and wider at the outside. The direction of lay may also be reversed at a certain radial thickness, a factor which depends on the design of the taping machine.

Insulating tapes 16 are wound in overlapping spiral layers so that each butt gap 24 between spirals of the same layer is offset from butt gap 26 of the layer below. This construction is facilitated by the production of the insulating tape containing color.

Polyolefin tapes such as polyethylene, polybutene and polypropylene, when highly oriented as required for the present invention, are transparent. This clarity becomes a disadvantage when the butt gaps of many layers show through to the surface of the cable very clearly. The operator of the winding machine then has difficulty distinguishing butt gap 26 of the immediate previous layer, from which new butt gap 24 must be offset, from other butt gaps deeper within the cable.

The insulating tape of the present invention therefore has a color component added to it so that the deeper a layer is within the cable, the darker it appears. Organic dyes are used to produce this color because these organic compounds, unlike inorganic metal salts, have less detrimental effect on the loss tangent and permittivity of the tape.

Since a balance between the needed color and effects on the electrical characteristics must be struck, organic dyes are added to the polyolefin feed stock in the proportions ranging between 100 to 1000 parts per million.

This results in a reduction in the light transmission of the tape to 10 to 50 percent of the original transmission. When the tape is used on a cable this reduces the visibility to one to two layers, whereas within color, butt gaps as deep as eight to ten layers within the insulation are still visible.

The characteristics of the insulating tapes are also influenced by several other factors in the raw material feedstock from which the tapes are produced. Antioxidants must, for instance, be limited to a range of 100 to 1000 parts per million and be limited to products in the group identified as IONOL, C.P; DLTDP; and TOPANOL, C.A. These products when used in the limited quantity noted only slightly affect the inherent nonpolar structure of the polyolefin and permit a dielectric loss tangent of less than $2\times10^{-4}$ to be attained under operating conditions.

The properly constituted resin, with limited antioxidants and with appropriate color added, is then extruded into tape by the method detailed below, but further processing is required before direct use in an oil impregnated cable. The tape is then biaxially oriented and embossed.

Orientation is accomplished in the machine direction by hot rolling of the raw tape to produce a thickness reduction ratio of between 5 to 1 and 10 to 1.

The thickness reduction ratio is in fact a measurement of the linear tape orientation and is an indication of the changing tensile characteristics of the polymer. The hot rolling process is performed at temperatures between 5 and 40 degrees C. below the melting point of the particular polymer. Thus, polyethylene is oriented with roller temperatures between 90 and 125 degrees C. and polypropylene is processed between 120 and 155 degrees C.

Before rolling, the tape is also processed to orient it in the cross-tape direction to a reduction ratio of up to 50%. This is necessary because without such processing polymers tend to fibrillate, that is, to separate into individual fibers across their width and cause the tape to split lengthwise.

The biaxial orientation given to the tapes is a key to their use in oil impregnated cables. The cable of the preferred embodiment of FIG. 1 is impregnated with a widely used type of polybutene oil, such as Cosden, Chevron or Amoco cable oil, which closely matches the dielectric constant of the tape. This minimizes stress intensification at the oil-tape interfaces and therefore yields superior voltage characteristics. Without the special processing, the polyethylene tape would, however, probably either swell in thickness, shrink in length, dissolve or suffer stress cracking. Prior to this invention it has therefore been virtually impossible to construct successfully operational impregnated cables from the economical polyolefins using common low cost impregnants.

Polyolefin tapes resulting from the processing specified above, however, have a tensile modulus of at least 250,000 psi in the length (machine) direction, and meet all the criteria required for cable manufacture. They have demonstrated less than 3% dimensional change after 5000 hours in 100° C. oil. Moreover, stress cracking tests on such tapes in 100° C. polybutene oil for 1000 hours indicate no problems at strain levels below 3%.

The tensile strength attained by the tapes through the processing is not only an indication of the resistance to deterioration in oil, but also a necessity for the use on cable taping machines. Tapes processed as described above can therefore be used on conventional cable making machines with tensions great enough to construct a satisfactorily tightly wound cable.

Before final construction into a cable, the polyolefin tape is embossed to furnish spacing between the tape layers which will facilitate oil impregnation and permit relatively free flow of the oil within the cable to enhance heat transfer.

Figure 2:
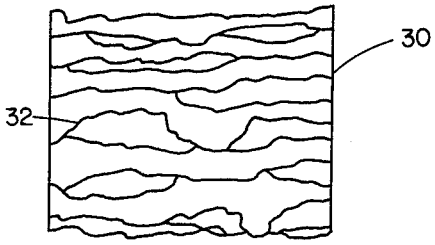
FIG. 2 is a top view of a typical embossing pattern used in the invention.

These goals are accomplished by a specific embossing technique. The cable is embossed by heated rollers at 5° to 10° C. below the previous rolling temperature. Other methods of preheating the tape itself, as opposed to using heated rollers, are unsatisfactory because they cause heat shrinking and distortion of the tapes. A typical pattern of embossing is shown in FIG. 2 which is a top view of a small section of tape 30 with valleys 32 in the pattern shown as dark lines.

The embossing pattern is characterized as irregular and preferentially permitting cross-tape flow of impregnant as opposed to flow along the length of the tape. The "wiggly line" pattern of irregular valleys running essentially across the tape width as seen in FIG. 2 meets these criteria and, unlike a pattern of regular grooves or channels, it can not interlock adjacent tape layers. Non-uniform and irregular patterns therefore assure that the various tape layers can move small distances relative to each other and yield the degree of flexibility required to manufacture and install the cable.

The cross-flow favoring pattern provides heat transfer and impregnation capabilities for the cable which far surpass any results previously available from paper insulated cables. Although it is well understood that kraft paper itself is permeable and polymers are not, the mechanism available for impregnation and heat transfer in the present cable does not depend upon the permeability of the material itself.

The embossed pattern is such that it doubles the effective tape thickness, that is, the peak to peak thickness is twice the distance of the original tape thickness. The tape is then compressed during winding to an apparent thickness one and one-half times the original tape thickness. Embossing is accomplished by rollers which cause a depression in one surface of the tape and a protrusion in the other surface. Once wound into a cable, these surface irregularities separate the tape layers; but since the pattern favors across-the-tape oil flow, oil need only flow, at the most, one-half the width of the tape to or from a butt gap where it can then progress to the next space between the tapes. This results in a relatively short path for oil from the outside of the cable to the conductor.

Two typical patterns of embossing are: a "coarse" pattern with a typical 0.1 mm mid-height width of the "valleys" and a typical 0.2 mm spacing between adjacent peaks; and a "fine" pattern with typical 0.025 mm mid-height valley widths and typical 0.05 mm spacing between peaks.

The availability of embossing patterns ranging from coarse to fine allows the cable designer to strike a compromise between heat transfer and operating stress. The coarse pattern provides the best heat transfer with some reduction in operating voltage stress compared to the fine pattern and vice versa.

The results of this type of embossing can be quantitatively measured by measuring cable impregnation rates. Contact angle measurements taken on embossed polyethylene tape with impregnating oil are all in the range of 25 degrees or less, indicating very favorable characteristics for oil wetting and oil flow.

Tests on the impregnation time of cable sections constructed according to the invention indicate that the impregnation time of an embossed polyethylene cable similar to the preferred embodiment of FIG. 1 can be as little as 60 minutes. This is attributable to the embossing and good wetting characteristics of the polyethylene tape, since the material itself has no significant permeability.

The free flow of impregnant indicated by the short impregnation time of the cable also yields a further beneficial and unexpected result. The cable of the preferred embodiment exhibits heat transfer abilities which are much better than those of equivalent kraft paper cables. This enhanced heat transfer, which has been measured as 6 times better than kraft paper insulated cables at oil temperatures of 100 degrees C., is the result of much better oil circulation within the cable, since heat transfer comparisons between dry polyethylene cables and dry kraft paper cables indicate only slightly better heat conduction characteristics for the polyethylene cable. The improvement in heat transfer for the oil filled cables is dramatically greater for the cable of the preferred embodiment as opposed to kraft paper. This improvement is due to the particular details of the embossing pattern and the superior wetting characteristics which permit natural convection of the oil within the insulation, transferring heat from within the cable to outer cover 22 (FIG. 1).

This free flow of oil is aided by assuring that outer screen 18 and conducting layer 20 are sufficiently permeable to the impregnant to not impede the free flow of oil which results within taped layers 16. Oil flow through outer layers 18 and 20 which are materials which have poor inherent permeability is attained through a series of small holes 28 perforated through each of the layers. These holes have no adverse effect upon the electrical function of layer 18 and conducting layer 20, but permit oil to move through the layers, both during initial impregnation and as a heat transfer medium during operation.

A better understanding of the construction of the cable of the invention can be attained through a sample listing of the layers of the typical cable of FIG. 1 constructed according to the invention. Listed from the center conductor outward, a 230 kV cable has the following layers.

(1) Conductor 12, 1.08 in O.D. compact round aluminum with a nominal rating of 900 amperes.
(2) Screening and bedding layer 14, 1.10 in O.D., 2 layers carbon loaded paper, $\frac{3}{4}$" wide.
(3) Insulating tapes 16, 1.65 in O.D., 44 layers embossed polyethylene, 14 layers $\frac{3}{4}$" wide, 16 layers $\frac{7}{8}$" wide, 14 layers 1 inch wide, each layer about 0.006 inches thick after taping.
(4) Screen 18, 1.67 in O.D., 2 layers carbon loaded paper, 1 inch wide.
(5) Conducting layers 20, 1.71 inch O.D., 2 layers stainless steel with one polymer layer under stainless steel and a mylar layer between the stainless steel layers.
(6) Skid tape 22, 1.716 O.D. one layer mylar tape.

The exceptional heat transfer characteristics of the cable of the present invention permit an alternate embodiment of the cable which has previously been impractical for high voltage, high power cables, but which supplements the utility of the cable substantially. The embodiment is shown in FIG. 3 and is an externally cooled cable.

Figure 3B:
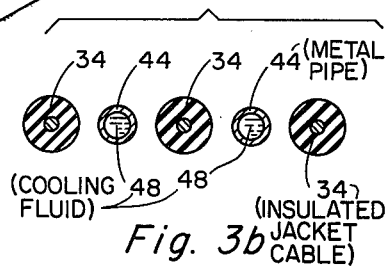
FIGS. 3A and 3B are cross sections of cable installations with external cooling.
Figure 3A:
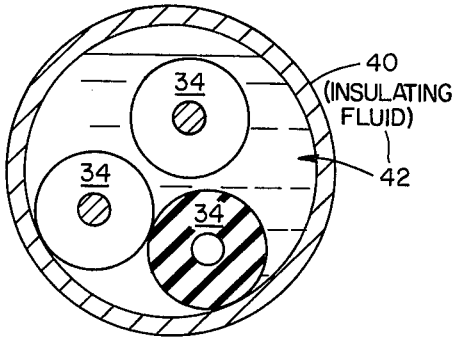

A typical three-phase installation is shown in FIG. 3A in which three cables 34 lie in steel pipe 40 which is welded in sections and the cables pulled through when sufficient length has been welded together. Pipe 40 is filled with impregnating fluid 42 under positive pressure. Forced cooling of the transmission cable is accomplished by circulating fluid 42 and periodically cooling it at various stations (not shown) along the transmission route. This method, well known to practitioners of the art, is the preferred way to utilize the superior heat transfer of the cable insulation. Because of the superior heat transfer it is practical to cool the oil with ambient air instead of the refrigerated fluids now necessary for this type of force-cooled system. Another way, as shown in FIG. 3B, also known to those skilled in the art, is to bury one or more pipes 44 adjacent to self-contained and jacketed cables 34. Cooling fluid 48 is circulated through pipe 44 and removes the heat generated in cables 34.

One non-liquid cooled cable designed according to the teaching of the present invention is rated for 550 kV and 1500 amperes with a cable O.D. of only 3.63 inches within a 10.25 inch diameter pipe. This design has a power factor of 0.015 percent and a thermal resistivity of 250 C.°-cm/W.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, other impregnants and different polymer insulating tapes could be used. Moreover, either standard, solid or hollow conductors could be used in the cable, and different insulating tape thicknesses and widths could be used.

We claim:

1. A high voltage power cable comprising multiple layers, one on top of another without paper between them, of biaxially oriented embossed polymer tape insulation over a conductor and impregnated with high dielectric strength insulating oil.

2. The high voltage cable of claim 1 wherein the polymer tape insulation is selected from one of the group of polyolefins of polyethylene, polybutene and polypropylene.

3. The high voltage cable of claim 1 wherein the high voltage insulating oil is polybutene.

4. The high voltage cable of claim 1 wherein the polymer tape insulation is oriented in the machine direction by processing to produce tape thickness reduction ratios of between 5 to 1 and 10 to 1.

5. The high voltage cable of claim 1 wherein the polymer tape insulation is oriented in the cross-tape direction by processing to produce a tape thickness reduction ratio of up to 50%.

6. The high voltage cable of claim 1 wherein the polymer tape insulation is embossed in a pattern which preferentially permits impregnant flow across the tape width.

7. The high voltage cable of claim 1 wherein the polymer tape is embossed in a pattern of irregular hills and valleys running across the tape.

8. The high voltage cable of claim 1 wherein the polymer tape insulation is produced from material containing antioxidant additives in a quantity within the range of 100 to 1000 parts per million.

9. The high voltage cable of claim 1 wherein the polymer tape insulation is produced from material containing antioxidant additives selected from the group of IONOL, C.P.; DLTDP; and TOPANOL, C.P.

10. The high voltage cable of claim 1 wherein the polymer tape insulation is produced from material which contains organic color dye in a quantity within the range of 100 to 1000 parts per million.

11. The high voltage cable of claim 1 wherein the polymer tape insulation is embossed in a pattern which doubles the effective tape thickness.

12. The high voltage cable of claim 1 wherein the polymer tape insulation is embossed in a pattern with a typical 0.2 mm spacing between the adjacent peaks.

13. The high voltage cable of claim 1 wherein the polymer tape insulation is embossed in a pattern with a typical 0.05 mm spacing between peaks.

14. The high voltage cable of claim 1 wherein the polymer tape insulation has a tensile modulus of at least 250,000 psi.

15. The high voltage cable of claim 1 wherein the combination of the polymer tape insulation and the insulating oil yields a contact angle of 25 degrees or less.

16. The high voltage cable of claim 1 further including a pipe enclosing the tape insulation and the insulating oil in which the insulating oil is circulated and periodically cooled at points along the transmission route.

17. The high voltage cable of claim 1 further including a jacket enclosing the tape insulation and the insulating oil, the jacket being adapted to be positioned adjacent to a pipe that has cooling fluid circulated through it.

18. The high voltage power cable of claim 1 further including at least one outer layer covering the tape insulation with small holes perforated through the outer layer to permit free flow of the oil through it.

* * * * *